US007374410B2

(12) United States Patent
Hwang et al.

(10) Patent No.: US 7,374,410 B2
(45) Date of Patent: May 20, 2008

(54) LOW-PRESSURE TYPE ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 11/208,531

(22) Filed: Aug. 23, 2005

(65) Prior Publication Data

US 2006/0177335 A1 Aug. 10, 2006

(30) Foreign Application Priority Data

Feb. 4, 2005 (KR) ..... 10-2005-0010736

(51) Int. Cl.
*F01C 1/02* (2006.01)
*F01C 1/063* (2006.01)

(52) U.S. Cl. ..... 418/59; 418/64; 418/63

(58) Field of Classification Search ..... 418/55.1–55.6, 418/64, 57, 58; 417/310, 212
See application file for complete search history.

(56) References Cited

U.S. PATENT DOCUMENTS 4,767,293 A * 8/1988 Caillat et al. ..... 418/55.3
5,383,773 A * 1/1995 Richardson, Jr. ..... 418/57
6,807,821 B2 * 10/2004 Narney, II ..... 62/324.6

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is a low-pressure type orbiting vane compressor that is capable of diverging low-temperature and low-pressure refrigerant gas introduced into a shell through an inlet tube to an inlet port of a cylinder and a drive unit so as to simultaneously compress the refrigerant gas and cool the drive unit. The orbiting vane compressor comprises a vertical baffle disposed in the shell while being spaced apart from the inner end of the inlet tube, and a diverging channel defined between the baffle and the inlet tube, the diverging channel having one end communicating with the inlet port of the cylinder and the other end communicating with the drive unit. Consequently, the present invention has the effect of preventing overheating of the drive unit, and therefore, improving performance and reliability of the orbiting vane compressor.

8 Claims, 3 Drawing Sheets

LOW-PRESSURE TYPE ORBITING VANE COMPRESSOR

BACKGROUND OF THE INVENTION

1. Field of the Invention

The present invention relates to an orbiting vane compressor, and, more particularly, to a low-pressure type orbiting vane compressor that is capable of diverging low-temperature and low-pressure refrigerant gas introduced into a shell through an inlet tube to an inlet port of a cylinder and a drive unit so as to simultaneously compress the refrigerant gas and cool the drive unit, and directly discharging compressed refrigerant gas out of a shell of the orbiting vane compressor.

2. Description of the Related Art

Generally, an orbiting vane compressor is constructed to compress refrigerant gas introduced into a cylinder through an orbiting movement of an orbiting vane in the cylinder having an inlet port. Various types of orbiting vane compressors, which are classified based on their shapes, have been proposed.

FIG. 1 is a longitudinal sectional view illustrating the overall structure of a conventional high-pressure type orbiting vane compressor. As shown in FIG. 1, a drive unit D and a compression unit P, which is disposed below the drive unit D, are mounted in a shell 1 while the drive unit D and the compression unit P are hermetically sealed. The drive unit D and the compression unit P are connected to each other via a vertical crankshaft 6, which has an eccentric part 6*a*.

The drive unit D comprises: a stator 2 fixedly disposed in the shell 1; and a rotor 3 disposed in the stator 2 for rotating the crankshaft 6, which vertically extends through the rotor 3, when electric current is supplied to the rotor 3.

The compression unit P comprises an orbiting vane 4 for performing an orbiting movement in a cylinder 5 by the eccentric part 6*a* of the crankshaft 6. As the orbiting vane 4 performs the orbiting movement in the cylinder 5, refrigerant gas introduced into the cylinder 5 through an inlet port 51 is compressed. The cylinder 5 has an inner ring 52. Between the inner ring 52 and the inner wall of the cylinder 5 is defined an annular operation space 53. A wrap 40 of the orbiting vane 4 performs an orbiting movement in the operation space 53. As a result, compression chambers are formed at the inside and the outside of the wrap 40, respectively.

At the upper and lower parts of the compression unit P are disposed a main frame 7 and a subsidiary frame 7*a*, which support opposite ends of the crankshaft 6. The subsidiary frame 7*a* has a discharge chamber 8*a*, which is formed by a muffler 8. The discharge chamber 8*a* is connected to a pipe-shaped discharge channel 9, which extends vertically through the compression unit P and the main frame 7, such that the compressed refrigerant gas is discharged into the shell 1 through the discharge channel 9.

Unexplained reference numeral 11 indicates an inlet tube, 12 an outlet tube, and 10*a* an Oldham's ring for preventing rotation of the wrap 40 of the orbiting vane 4.

When electric current is supplied to the drive unit D, the rotor 3 of the drive unit D is rotated, and therefore, the crankshaft 6, which vertically extends through the rotor 3, is also rotated. As the crankshaft 6 is rotated, the orbiting vane 4 attached to the eccentric part 6*a* of the crankshaft 6 performs an orbiting movement.

As a result, the wrap 40 of the orbiting vane 4 performs an orbiting movement in the operation space 53 of the cylinder 5 to compress refrigerant gas introduced into the cylinder 5 through the inlet port 51 in the compression chambers formed at the inside and the outside of the wrap 40, respectively. The compressed refrigerant gas is discharged into the discharge chamber 8*a* through inner and outer outlet ports (not shown) formed at the cylinder 5 and the subsidiary frame 7*a*. The discharged high-pressure refrigerant gas is guided into the shell 1 through the discharge channel 9. Finally, the compressed refrigerant gas is discharged out of the shell 1 through the outlet tube 12.

FIG. 2 is a plan view, in section, illustrating the compressing operation of the conventional orbiting vane compressor shown in FIG. 1.

As shown in FIG. 2, the wrap 40 of the orbiting vane 4 of the compression unit P performs an orbiting movement in the operation space 53 of the cylinder 5, as indicated by arrows, to compress refrigerant gas introduced into the operation space 53 through the inlet port 51. The orbiting movement of the wrap 40 of the orbiting vane 4 will be described hereinafter in more detail.

At the initial orbiting position of the wrap 40 of the orbiting vane 4 of the compression unit P (i.e., the O-degree orbiting position shown in view (a) of FIG. 2), refrigerant gas is introduced into an inner suction chamber A1, which is disposed at the inside of the wrap 40, through the inlet port 51, and compression is performed in an outer compression chamber B2, which is disposed at the outside of the wrap 40, while the outer compression chamber B2 does not communicate with the inlet port 51 and an outer outlet port 53*b*. Refrigerant gas is compressed in an inner compression chamber A2, and at the same time, the compressed refrigerant gas is discharged out of the inner compression chamber A2.

At the 90-degree orbiting position of the wrap 40 of the orbiting vane 4 of the compression unit P (shown in view (b) of FIG. 2), the compression is still performed in the outer compression chamber B2, and almost all the compressed refrigerant gas is discharged out of the inner compression chamber A2 through an inner outlet port 53*a*. At this stage, an outer suction chamber B1 appears so that refrigerant gas is introduced into the outer suction chamber B1 through the inlet port 51.

At the 180-degree orbiting position of the wrap 40 of the orbiting vane 4 of the compression unit P (shown in view (c) of FIG. 2), the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 53*b*. Consequently, the compressed refrigerant gas is discharged out of the outer compression chamber B2 through the outer outlet port 53*b*.

At the 270-degree orbiting position of the wrap 40 of the orbiting vane 4 of the compression unit P (shown in view (d) of FIG. 2), almost all the compressed refrigerant gas is discharged out of the outer compression chamber B2 through the outer outlet port 53*b*, and the compression is still performed in the inner compression chamber A2. Also, compression is newly performed in the outer suction chamber B1. When the orbiting vane 4 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the wrap 40 of the orbiting vane 4 of the compression unit P is returned to the position where the orbiting movement of the orbiting vane 4 is initiated. In this way, a 360-degreeper-cycle orbiting movement of the wrap 40 of the orbiting vane 4 of the compression unit P is accomplished. The orbiting movement of the wrap 40 of the orbiting vane 4 of the compression unit P is performed in a continuous fashion.

Unexplained reference numeral 55 indicates a slider for maintaining the seal between the high-pressure and low-pressure parts.

In the conventional high-pressure type orbiting vane compressor according to the above-mentioned description, however, high-temperature and high-pressure compressed refrigerant gas is discharged into the shell. As a result, the temperature of the drive unit and the structural components of the orbiting vane compressor is excessively increased, and therefore, the drive unit and the structural components of the orbiting vane compressor are deformed or damaged. Consequently, the performance of the compressor is deteriorated, and the service life of the compressor is reduced.

SUMMARY OF THE INVENTION

Therefore, the present invention has been made in view of the above problems, and it is an object of the present invention to provide a low-pressure type orbiting vane compressor that is capable of diverging low-temperature and low-pressure refrigerant gas introduced into a shell through an inlet tube to an inlet port of a cylinder and a drive unit so as to simultaneously compress the refrigerant gas and cool the drive unit, and directly discharging compressed refrigerant gas out of a shell of the orbiting vane compressor.

In accordance with the present invention, the above and other objects can be accomplished by the provision of a low-pressure type orbiting vane compressor, comprising: a hermetically sealed shell having an inlet tube and an outlet tube; a crankshaft disposed in the shell such that the crankshaft can be rotated by a drive unit; a compression unit including an orbiting vane connected to the crankshaft and disposed in a cylinder for performing an orbiting movement to compress refrigerant gas introduced into the cylinder; and a diverging member for diverging refrigerant gas introduced into the shell through the inlet tube to an inlet port of the cylinder and the drive unit.

Preferably, the diverging member comprises: a vertical baffle disposed in the shell while being spaced apart from the inner end of the inlet tube; and a diverging channel defined between the baffle and the inlet tube, the diverging channel having one end communicating with the inlet port of the cylinder and the other end communicating with the drive unit.

Preferably, the low-pressure type orbiting vane compressor further comprises: an introduction guide formed between the inlet port of the cylinder and the diverging channel for guiding the refrigerant gas introduced through the diverging channel to the inlet port of the cylinder.

Preferably, the introduction guide is disposed such that the introduction guide is higher than the level of oil in an oil sump.

Preferably, the compression unit P has upper and lower parts supported by a main frame and a subsidiary frame, respectively.

Preferably, the low-pressure type orbiting vane compressor further comprises: an annular operation space defined between an inner ring and an inner wall of the cylinder, and the operation space is divided into inner and outer compression chambers by a wrap of the orbiting vane, which is disposed in the operation space.

Preferably, the cylinder has outlet ports, which communicate with the inner and outer compression chambers, respectively, and the low-pressure type orbiting vane compressor further comprises: a muffler disposed below the outlet ports of the cylinder, the muffler having a discharge chamber defined therein for allowing the compressed refrigerant gas to be discharged into the discharge chamber.

Preferably, the discharge chamber communicates with the outlet tube of the shell such that the compressed refrigerant gas is discharged out of the shell from the discharge chamber through the outlet tube.

Preferably, the cylinder is provided at one side thereof with an inlet port for allowing refrigerant gas to be introduced into the cylinder therethrough.

Preferably, the inlet tube is disposed such that the inlet tube is higher than the inlet port of the cylinder.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
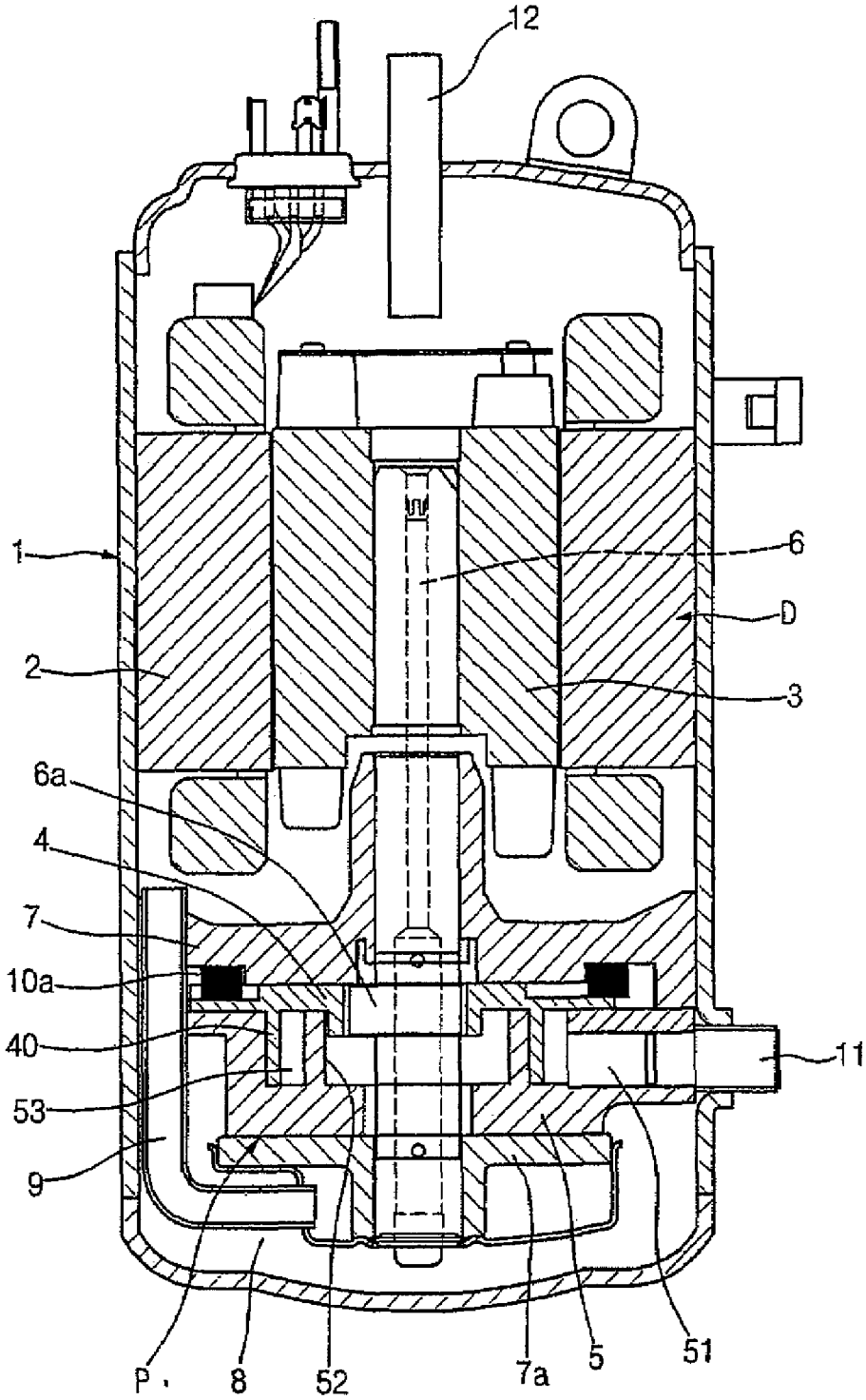
FIG. 1 is a longitudinal sectional view illustrating the overall structure of a conventional high-pressure type orbiting vane compressor.
Figure 2:
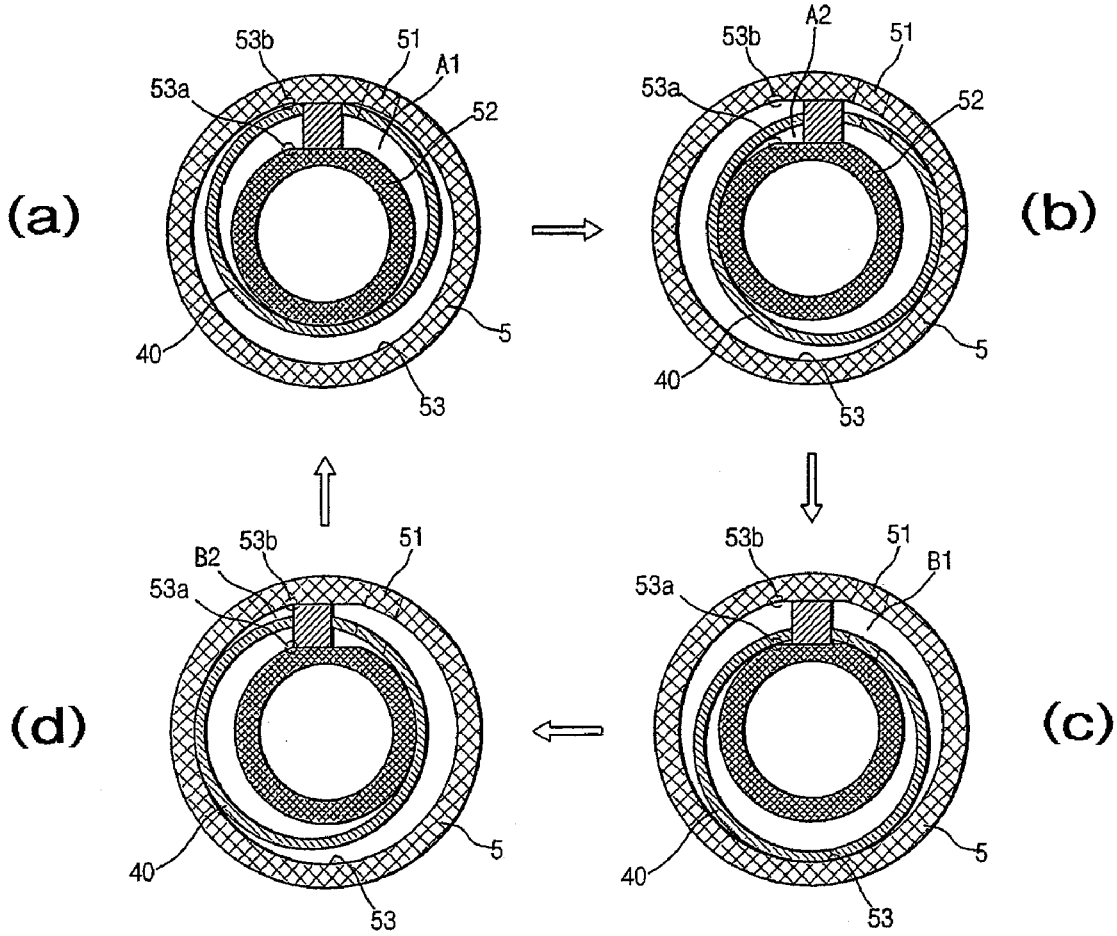
FIG. 2 is a plan view, in section, illustrating the compressing operation of the conventional high-pressure type orbiting vane compressor shown in FIG. 1.
Figure 3:
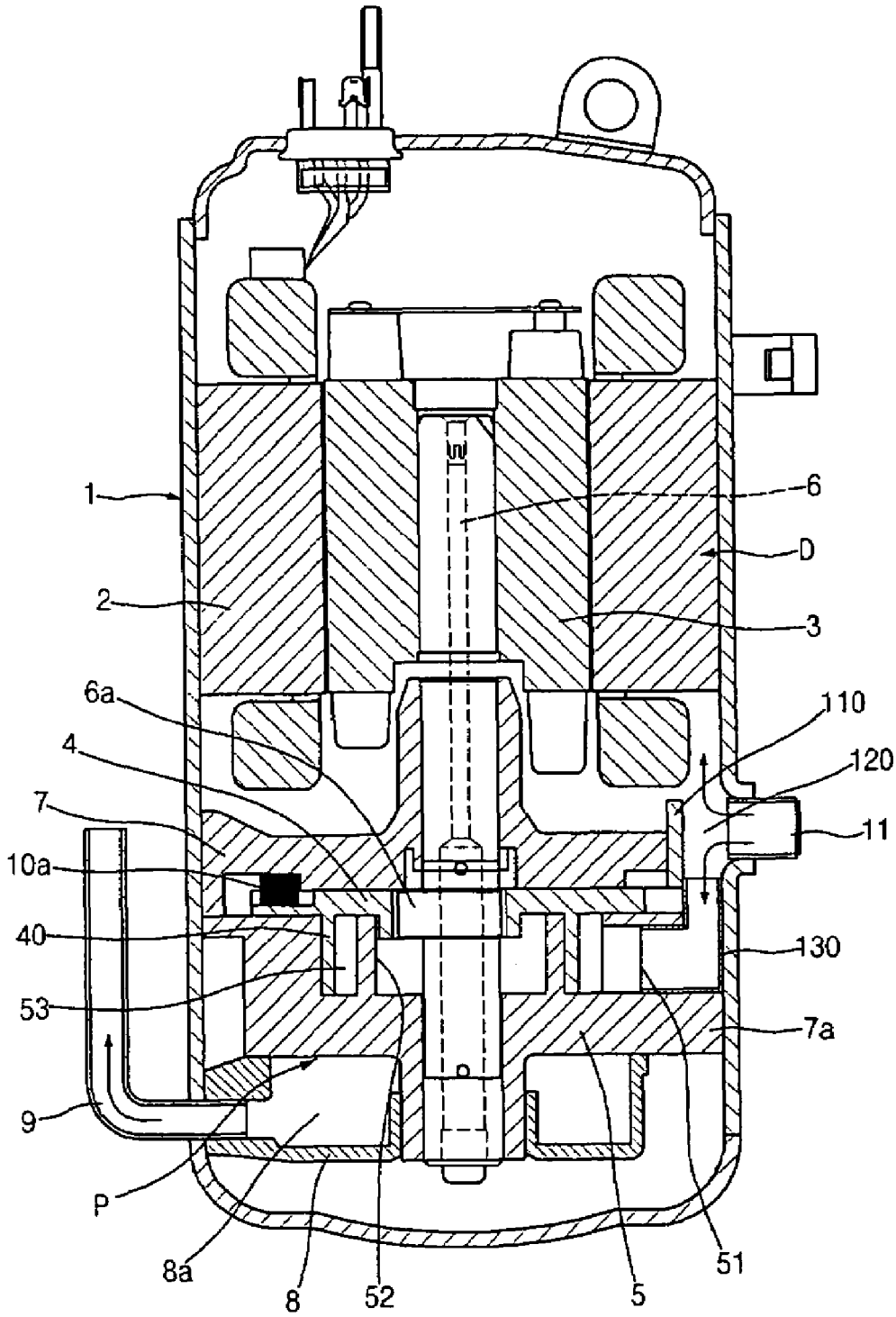
FIG. 3 is a longitudinal sectional view illustrating the overall structure of a low-pressure type orbiting vane compressor according to the present invention.

FIG. 3 is a longitudinal sectional view illustrating the overall structure of a low-pressure type orbiting vane compressor according to the present invention.

As shown in FIG. 3, a drive unit D and a compression unit P, which is disposed below the drive unit D, are mounted in a shell 1 while the drive unit D and the compression unit P are hermetically sealed. The drive unit D and the compression unit P are connected to each other via a vertical crankshaft 6, which has an eccentric part 6*a*.

The drive unit D comprises: a stator 2 fixedly disposed in the shell 1; and a rotor 3 disposed in the stator 2 for rotating the crankshaft 6, which vertically extends through the rotor 3, when electric current is supplied to the rotor 3.

The compression unit P comprises an orbiting vane 4 for performing an orbiting movement in a cylinder 5 by the eccentric part 6*a* of the crankshaft 6. As the orbiting vane 4 performs the orbiting movement in the cylinder 5, refrigerant gas introduced into the cylinder 5 through an inlet port 51 is compressed. The cylinder 5 has an inner ring 52. Between the inner ring 52 and the inner wall of the cylinder 5 is defined an annular operation space 53. A wrap 40 of the orbiting vane 4 performs an orbiting movement in the operation space 53. As a result, compression chambers are formed at the inside and the outside of the wrap 40, respectively. Specifically, the operation space 53 is divided into inner and outer compression chambers by the wrap 40 of the orbiting vane 4, which is disposed in the operation space 53.

The wrap 40 of the orbiting vane 4 has a through-hole (not shown), which communicates with the inlet port 51 of the cylinder 5. Also, the wrap 40 of the orbiting vane 4 has an opening (not shown), which is disposed adjacent to the through-hole. A slider (not shown) is disposed in the opening.

At the upper and lower parts of the compression unit P are disposed a main frame 7 and a subsidiary frame 7*a*, which support opposite ends of the crankshaft 6. The subsidiary frame 7*a* has a discharge chamber 8*a*, which is formed by a muffler 8. The discharge chamber 8*a* communicates with an outlet tube 9, which is disposed at the outside of the shell 1, such that the compressed refrigerant gas is discharged out of the shell 1 from the discharge chamber 8*a* through the outlet tube 9.

The low-pressure type orbiting vane compressor according to the present invention is characterized in that low-temperature and low-pressure refrigerant gas introduced into the shell 1 through an inlet tube 11 is diverged to an inlet port 51 of the cylinder 5 and the drive unit D. The low-temperature and low-pressure refrigerant gas diverged to the inlet port 51 of the cylinder 5 is introduced into the cylinder where the refrigerant gas is compressed. The low-temperature and low-pressure refrigerant gas diverged to the drive unit D cools the drive unit D.

To this end, the inlet tube 11 is mounted to the shell 1 such that the inlet tube 11 is higher than the inlet port 51 of the cylinder 5. Also, the orbiting vane compressor further comprises: a diverging member for diverging refrigerant gas introduced into the shell 1 through the inlet tube 11 to the inlet port 51 of the cylinder 5 and the drive unit D.

The diverging member comprises: a vertical baffle 110 disposed in the shell 1 while being spaced apart from the inner end of the inlet tube 11; and a diverging channel 120 defined between the baffle 110 and the inlet tube 11. One end of the diverging channel 120 communicates with the inlet port 51 of the cylinder 5, and the other end of the diverging channel 120 communicates with the drive unit D.

The orbiting vane compressor further comprises: an introduction guide 130 formed between the inlet port 51 of the cylinder 5 and the diverging channel 120 for guiding the refrigerant gas introduced through the diverging channel 120 to the inlet port 51 of the cylinder. The introduction guide 130 is disposed such that the introduction guide 130 is higher than the level of oil in an oil sump 13. Consequently, the low-temperature and low-pressure refrigerant gas introduced through the diverging channel 120 is not mixed with the oil by the provision of the introduction guide 130, although the compression unit P is partially or wholly submerged in the oil.

The low-temperature and low-pressure refrigerant gas introduced into the cylinder 5 through the diverging channel 120 and the introduction guide 130 is compressed in the cylinder 5. The compressed refrigerant gas, i.e., the high-temperature and high-pressure refrigerant gas, is discharged into the discharge chamber 8*a*, and is then discharged out of the shell 1 through the outlet tube 9, one end of which is connected to the muffler 8 defining the discharge chamber 8*a* such that the outlet tube 9 communicates with the discharge chamber 8*a* and the other end of which is disposed at the outside of the shell 1.

Now, the operation of the low-pressure type orbiting vane compressor with the above-stated construction will be described.

When electric current is supplied to the drive unit D, the rotor 3 of the drive unit D is rotated, and therefore, the crankshaft 6, which vertically extends through the rotor 3, is also rotated. As the crankshaft 6 is rotated, the orbiting vane 4 attached to the eccentric part 6*a* of the crankshaft 6 performs an orbiting movement.

As a result, a wrap 40 of the orbiting vane 4 performs an orbiting movement in the operation space 53 of the cylinder 5 to compress refrigerant gas introduced into the cylinder 5 through the baffle 110, the diverging channel 120, and the introduction guide 130 in compression chambers formed at the inside and the outside of the wrap 40, respectively. The compressed refrigerant gas is discharged into the discharge chamber 8*a* through inner and outer outlet ports (not shown) formed at the cylinder 5 and the subsidiary frame 7*a*. The discharged high-temperature refrigerant gas is discharged out of the shell 1 through the outlet tube 9. In this way, the compressed refrigerant gas is discharged. Meanwhile, the drive unit D is cooled by the low-temperature and low-pressure refrigerant gas diverged to the drive unit D through the diverging channel 120.

As apparent from the above description, the low-temperature and low-pressure refrigerant gas introduced into the shell through the inlet tube is diverged to the inlet port of the cylinder and the drive unit. As a result, some of the refrigerant gas is compressed, and at the same time, the drive unit is cooled by some of the refrigerant gas. The compressed refrigerant gas is directly discharged out of the shell. Consequently, the present invention has the effect of preventing overheating of the drive unit, and therefore, improving performance and reliability of the orbiting vane compressor.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A low-pressure type orbiting vane compressor, comprising:

a hermetically sealed shell having an inlet tube and an outlet tube;

a crankshaft disposed in the shell such that the crankshaft can be rotated by a drive unit;

a compression unit, including an orbiting vane connected to the crankshaft and disposed in a cylinder to perform an orbiting movement to compress refrigerant gas introduced into the cylinder; and a diverging member that diverges refrigerant gas introduced into the shell through the inlet tube to an inlet port of the cylinder and the drive unit, wherein the inlet port is provided at one side of the cylinder to allow refrigerant gas to be introduced into the cylinder and a wrap of the orbiting vane has a through-hole which communicates with the inlet port of the cylinder and an opening which is disposed adjacent to the through-hole and has a slider disposed in the opening.

2. A low-pressure type orbiting vane compressor, comprising:

a hermetically sealed shell having an inlet tube and an outlet tube;

a crankshaft disposed in the shell such that the crankshaft can be rotated by a drive unit;

a compression unit including an orbiting vane connected to the crankshaft and disposed in a cylinder to perform an orbiting movement to compress refrigerant gas introduced into the cylinder;

a diverging member that diverges refrigerant gas introduced into the shell through the inlet tube to an inlet port of the cylinder and the drive unit;

wherein the orbiting vane comprises:

a wrap protruding from a center of a lower side of the orbiting vane;

a through-hole disposed in the wrap;

an opening disposed at a side of the through-hole; and a slider that fits in the opening, and wherein the cylinder comprises:

an annular operation space defined between an inner ring and an inner wall of the cylinder;

an inlet port disposed at a side of the cylinder so as to communicate with the operation space to allow refrigerant gas to be introduced into the cylinder;

inner and outer compression chambers disposed in the operation space and defined by the wrap; and inner and outer outlet ports through which gas compressed in the compression chambers is discharged.

3. The compressor as set forth in claim 2, wherein the diverging member comprises:

a vertical baffle disposed in the shell and spaced apart from an inner end of the inlet tube; and a diverging channel defined between the baffle and the inlet tube, the diverging channel having one end communicating with the inlet port of the cylinder and another end communicating with the drive unit.

4. The compressor as set forth in claim 3, further comprising:

an introduction guide, formed between the inlet port of the cylinder and the diverging channel, that guides refrigerant gas introduced through the diverging channel to the inlet port of the cylinder.

5. The compressor as set forth in claim 4, wherein the introduction guide is disposed such that the introduction guide is higher than a level of oil in an oil sump.

6. The compressor as set forth in claim 2, further comprising:

a muffler disposed below the outlet ports of the cylinder, wherein the muffler has a discharge chamber defined therein into which the compressed refrigerant gas is discharged.

7. The compressor as set forth in claim 6, wherein the discharge chamber communicates with the outlet tube of the shell such that the compressed refrigerant gas is discharged out of the shell from the discharge chamber through the outlet tube.

8. The compressor as set forth in claim 2, wherein the inlet tube is disposed such that the inlet tube is higher than the inlet port of the cylinder.

* * * * *